US009644310B2

(12) United States Patent
Cimetta et al.

(10) Patent No.: US 9,644,310 B2
(45) Date of Patent: May 9, 2017

(54) HOUSEHOLD CLOTHES DRYING MACHINE WITH CLOTHES DISINFECTION CYCLE

(75) Inventors: Silvano Cimetta, Treviso (IT); Flavio Noviello, Pordenone (IT)

(73) Assignee: Electrolux Home Products Corporation N. V., Zaventem (BE)

( * ) Notice: Subject to any disclaimer, the term of this patent is extended or adjusted under 35 U.S.C. 154(b) by 1959 days.

(21) Appl. No.: 12/332,974

(22) Filed: Dec. 11, 2008

(65) Prior Publication Data

US 2009/0094854 A1 Apr. 16, 2009

Related U.S. Application Data

(63) Continuation of application No. 11/345,595, filed on Feb. 1, 2006, now abandoned.

(30) Foreign Application Priority Data

Mar. 8, 2005 (EP) ..... 05101778

(51) Int. Cl.

| | |
|---|---|
| ***D06F 58/00*** | (2006.01) |
| ***D06F 58/04*** | (2006.01) |
| ***D06F 58/20*** | (2006.01) |
| ***D06F 58/28*** | (2006.01) |

(52) U.S. Cl.

CPC ..... *D06F 58/20* (2013.01); *D06F 58/28* (2013.01); *D06F 2058/2829* (2013.01); *D06F 2058/2838* (2013.01); *D06F 2058/2896* (2013.01)

(58) Field of Classification Search

CPC .. D06F 58/20; D06F 58/28; D06F 2058/2896; D06F 2058/2838; D06F 2058/2829

USPC ..... 34/468, 486, 493, 495, 496

See application file for complete search history.

(56) References Cited

U.S. PATENT DOCUMENTS

| | | | | |
|---|---|---|---|---|
| 3,397,461 | A * | 8/1968 | Fogt et al. | 34/527 |
| 3,831,294 | A | 8/1974 | Freze | |
| 4,519,145 | A * | 5/1985 | Mandel | 34/389 |
| 6,678,969 | B1 | 1/2004 | Hong | |
| 7,020,982 | B2 * | 4/2006 | Park et al. | 34/496 |
| 2003/0050220 | A1 | 3/2003 | Trinh et al. | |

FOREIGN PATENT DOCUMENTS

| | | |
|---|---|---|
| EP | 0434169 A2 | 6/1991 |
| EP | 1108812 A1 | 6/2001 |
| EP | 1408151 A1 | 4/2004 |
| EP | 1475474 A1 | 11/2004 |
| GB | 0523670 A | 7/1940 |

* cited by examiner

*Primary Examiner* — Jiping Lu
(74) *Attorney, Agent, or Firm* — Pearne & Gordon, LLP

(57) ABSTRACT

Clothes drying machine comprising a drum holding the clothes to be dried, a first fan adapted to blow a first flow of drying air through said drum, and possibly a condenser adapted to condense the moisture out of the drying air exiting said drum. The machine is provided with a drying program that includes a step involving an increase in the temperature of the air introduced in said drum, in which said temperature is increased to a value of at least 130° C. and held there for a pre-set period of time, and said temperature increase step is provided in the initial portion of the drying program, when the moisture content of the clothes is not less than 20%.

34 Claims, 5 Drawing Sheets

FIG. 1
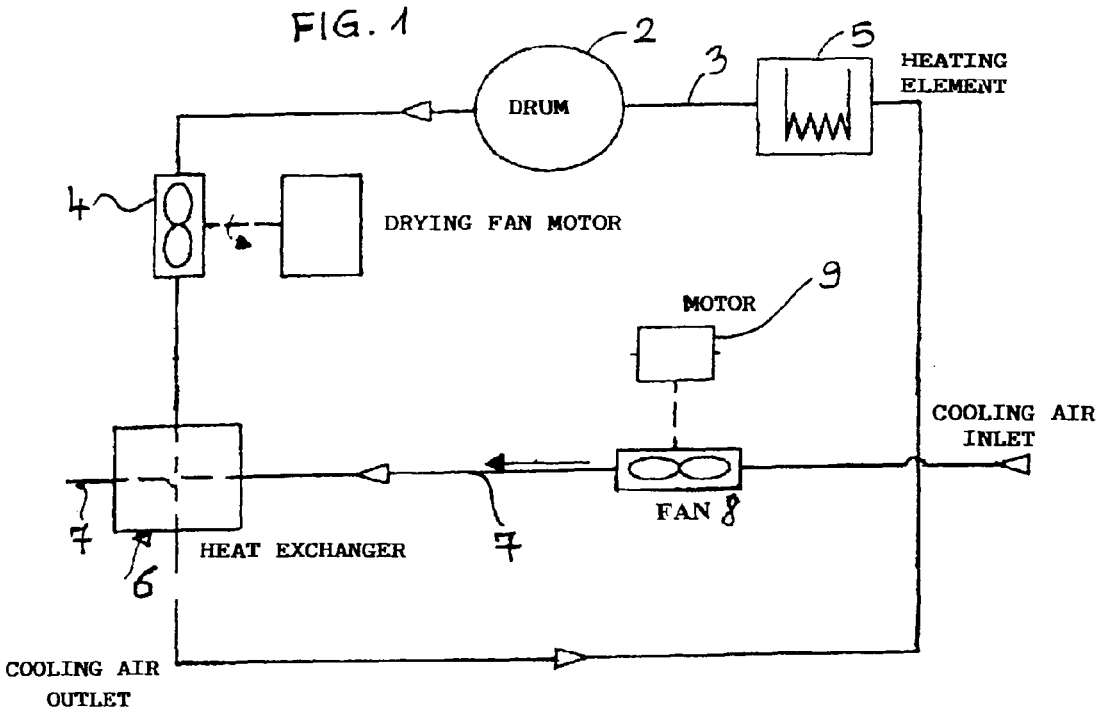
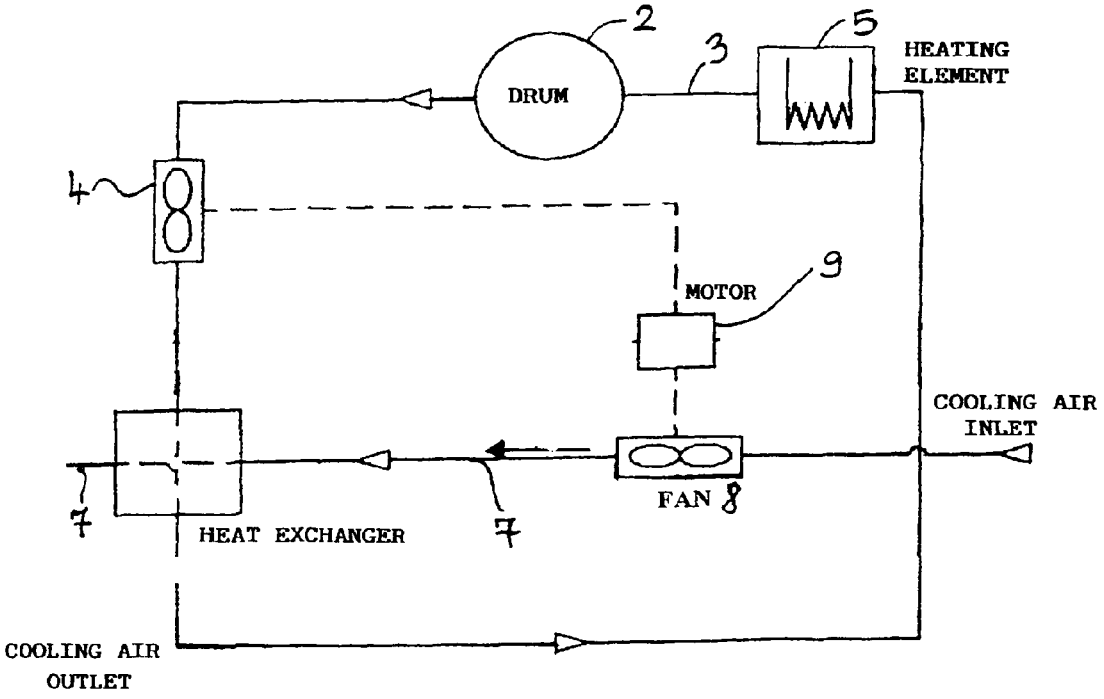
FIG. 2

HOUSEHOLD CLOTHES DRYING MACHINE WITH CLOTHES DISINFECTION CYCLE

CROSS-REFERENCE TO RELATED APPLICATIONS

This application is a continuation of U.S. application Ser. No. 11/345,595, filed on Feb. 1, 2006 which claims the benefit of European application Serial No. 05101778.8, filed on Mar. 8, 2005. These applications are incorporated herein by reference.

The present invention refers to an improved kind of clothes drying machine, preferably of the type for use in households, which is intended for carrying out clothes drying cycles that include an over-heating step, i.e. a step performed at a higher temperature than the drying one, the purpose of which is to bring about a disinfecting effect in the drying load, i.e. the clothes being dried.

Although reference to an autonomous, i.e. single-duty clothes drying machine will be made throughout the following description, it shall be appreciated that what is set forth below may similarly be applied to and, therefore, be suitable for combined clothes washing and drying machines.

Known in the art are clothes drying machines designed to operate in accordance with different principles. In a first one of these designs, the machine comprises an air-intake conduit, which takes in air from the outside ambient and delivers it into and through the drum holding the drying load, and an exhaust conduit that conveys the air from the interior of the drum out again into the outside ambient; in the air intake conduit there are also provided a fan to ensure a forced-flow circulation of the drying air, and an electric heating element to heat up the air flowing over it prior to entering the drying drum.

In a second one of these current designs, the clothes drying machine comprises means adapted to condense the moisture contained in the flow of hot air that is blown into and through the drum and removes the moisture from the clothes being tumbled to dry in the same drum, wherein said flow of air is re-circulated, i.e. sent again into the drum via a closed-loop circuit upon having in this way given off its moisture content in said condensation process.

Anyway, this second kind of clothes drying machines is extensively described in the European patent application no. EP 1 475 474, to which reference should therefore be made for reasons of greater convenience and brevity in this description.

Usually, when clothes are washed and dried in corresponding washing and drying machines, the same clothes are expected to come out perfectly clean, so as to be capable of being re-used without any fear of possible health risks and problems.

As a matter of fact, the average temperatures at which clothes are handled during a typical washing and drying process, i.e. 50° C. to 60° C. for the washing liquor and 70° C. to 80° C. for the drying air, are effective in eliminating most bacteria and infecting substances that may be present in the clothes.

There are cases, however, in which the combined effect of the washing and drying processes may prove inadequate in reliably ensuring a desirably high level of antibacterial treatment of the washed and dried clothes; for instance, this may for quite obvious reasons be true when washing and drying diapers, nappies and other linens used for babies and small children in general; or this may for example be the case when washing and drying working clothes worn by certain categories of persons, such as doctors, surgeons, nurses, people dealing with animals in general, including butchers, and the like.

Such need for all these and other articles of clothing to be allowed to systematically undergo a disinfecting treatment can technically be complied with by letting them go through a conventional washing process, particularly if an adequately high washing temperature is selected. In fact, the combined action of a generally high temperature, which may reach up to 80° C., and is on average brought to 65° C. and kept at this value for at least 20 minutes, and the washing products and aids added to the washing liquor, in particular when these contain bleaching agent, brings about a well-known disinfection effect that proves fully adequate for the majority of the above-considered cases. It may at this point be appropriate to point out that a disinfection process is quite different from a sterilization process, which must by necessity be carried out with the use of dedicated processes and equipment of a professional kind, and which shall by no means be mistaken for a process of mere disinfection as considered here.

However, a disinfection performed in a systematic manner through a succession of washing treatments in a washing machine is not really free of drawbacks, which may even be of a serious nature: in the first place, in fact, a repeated treatment of the clothes at a high temperature with the use of detergent products, particularly if they contain bleaching agents, gives rise to not only an unavoidable wear and tear effect on the clothes, but also a conspicuous fading of the colours (that is actually the reason why most of the articles of clothing that require bleaching are white since the beginning, so that a fading effect thereof cannot be noticed!)

In addition, washing with water at a high temperature entrains a considerable energy usage in view of both heating it up to and holding it at the required temperature, and this most definitely clashes with the increasingly felt need for energy to be saved as much as possible in each and any process whatsoever, in particular at a household level.

A further serious drawback is encountered when it is required or desired that the clothes be treated for disinfection with a UV radiation process, which is widely known to be effective in ensuring remarkable bactericidal results; in fact, if the clothes due to undergo UV treatment are or include synthetic fabrics, they would most rapidly be substantially destroyed by such UV treatment.

It would therefore be desirable, and it is actually a main purpose of the present invention, to provide a clothes drying machine, either of the condenser or the exhaust type, i.e. in which the moisture-laden hot drying air is either condensed prior to being re-circulated or let directly out into the room, which is capable of carrying out a drying process during which the drying load undergoes a treatment ensuring a disinfection thereof.

In addition, such drying machine and such process shall not require any substantial modification to be introduced in the design and construction of existing clothes drying machines, shall ensure all other expected drying performance characteristics, and shall finally not imply any increase in the overall complexity of the machine, while keeping the manufacturing costs thereof as low as possible.

According to the present invention, this aim is reached, along with further ones that will be apparent from the following description, in a clothes drying machine incorporating the features as recited in the appended claims.

Anyway, features and advantages of the present invention will be more readily understood from the description that is given below by mere way of non-limiting example with reference to the accompanying drawings, in which:

FIGS. 1 and 2 are general symbolical schematic views of a clothes drying machine provided with condenser arrangement and two fans that are:

controlled and driven independently of each other and rigidly connected with each other, in which the present invention can be applied;

The basic idea behind the present invention lies in allowing the temperature of the drying air within the drum to sensibly increase, so that even the temperature of the clothes being dried in the drum is caused to increase to such a level as to ensure a desired disinfection effect, wherein it must anyway be duly pointed out that such temperature increase cannot take place when the clothes in the drum are substantially dry, since also the temperature of the clothes would in this case reach up to such a high value as to cause the same clothes to undergo a "baking"-like treatment, and this would most obviously make subsequent ironing much more difficult to carry out. Moreover, the energy used to bring about such marked temperature increase would in this case not be capable of being further exploited to practical purposes in the drying process, and would therefore end up by being substantially wasted, since the clothes have already been brought almost to the desired dry state thereof.

It is therefore appropriate—and this is exactly one of the basic principles, which the present invention is based on—for the above-mentioned increase in temperature to be provided and, hence, to take place when the clothes in the drum are still sufficiently wet. In particular, this condition occurs when there is still a moisture content of at least 30% remaining in the clothes.

In practice, the control means of the machine (not shown) must be provided so as to include—further to the usual drying cycles or programmes—a drying cycle that, when selected by the user and performed by the machine, goes automatically through an additional operating step, in which, when a pre-determined condition occurs, the drying process is conducted in a pre-defined manner.

Said pre-determined condition may for instance be a certain time being elapsed since the beginning of the drying cycle or, more preferably, the moisture content in the clothes having been sensed to have decreased to a value that is still higher than a pre-set level, when measured with means generally known as such in the art, e.g. conductivity measuring means.

Upon such pre-determined elapsed-time or residual-moisture condition having thus occurred in the clothes drying machine, one or more machine functions are activated so as to cause the temperature of the drying air to be brought up to a pre-set higher level, this condition being then maintained, i.e. allowed to continue for a pre-determined period of time.

Figure 7:
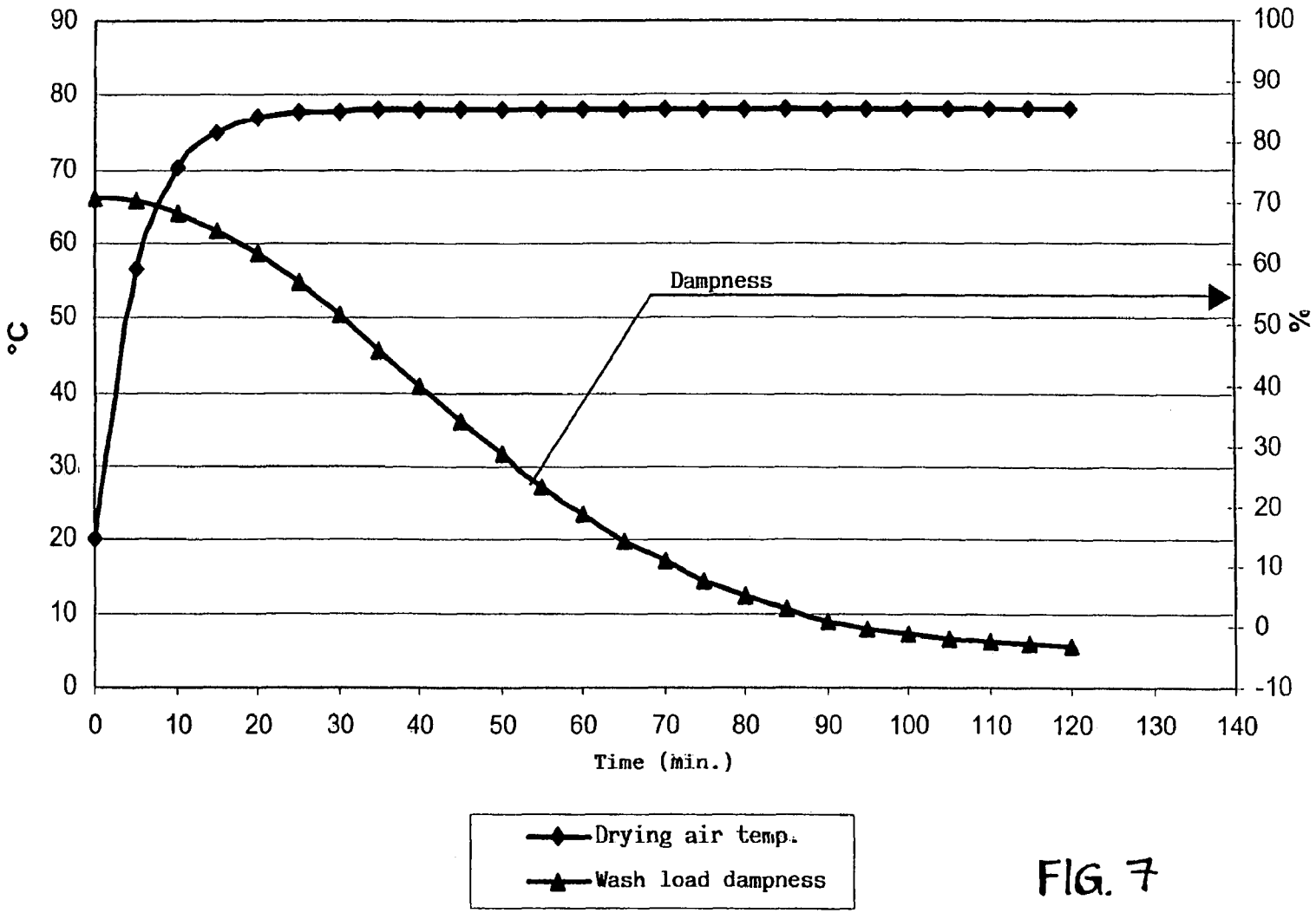
FIG. 7 is a diagrammatic view of the temperature and moisture curves in a drying cycle according to the prior art.
Figure 8:
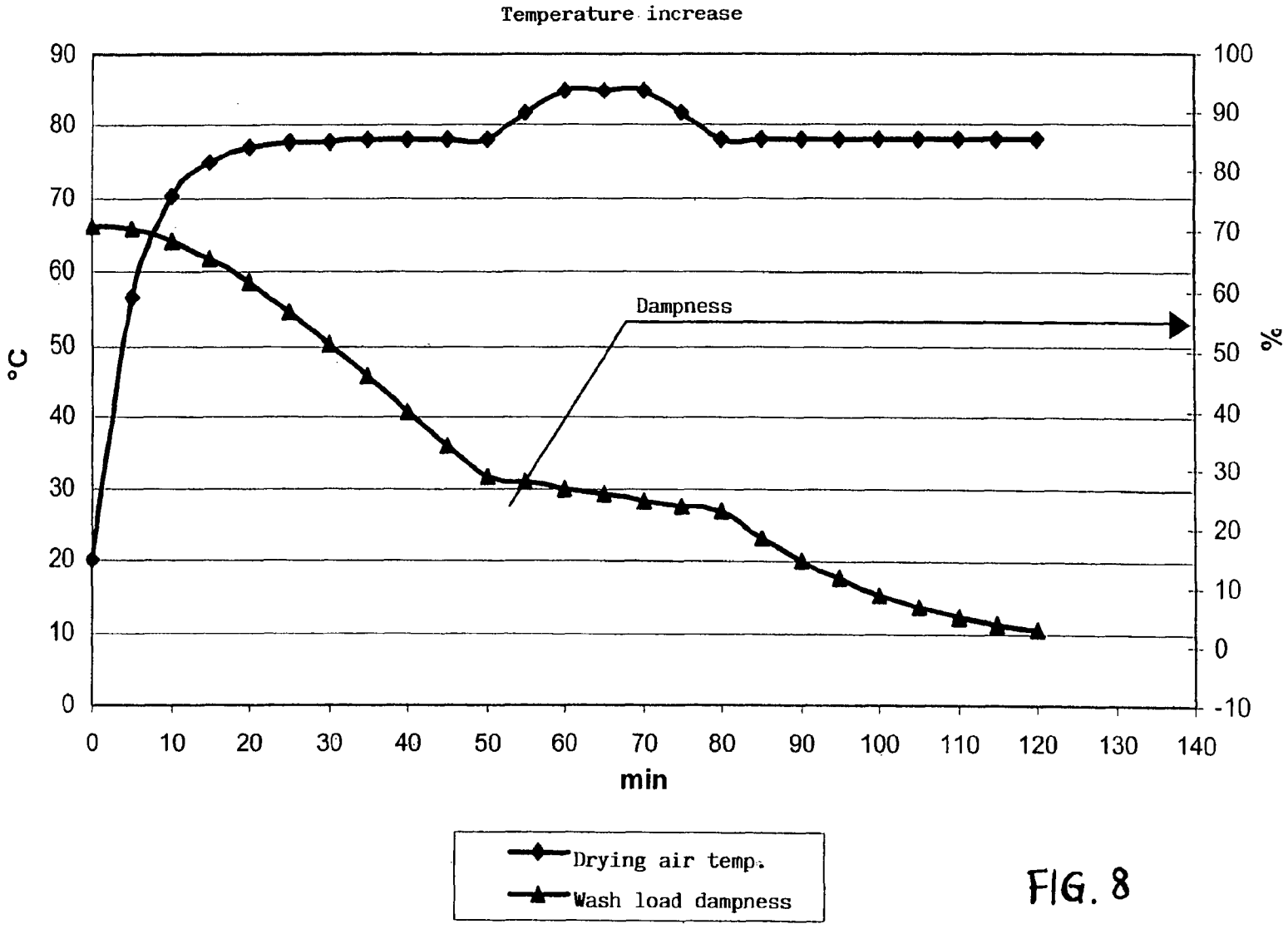
FIG. 8 is a diagrammatic view of the corresponding temperature and moisture curves in a drying cycle according to the present invention.

Such increase in the temperature of the drying air being circulated inside the machine can most clearly be inferred from a comparison of the curves shown in FIGS. 7 and 8 representing the situation in a drying cycle without and with the inventive feature, respectively.

Basically, the functions that are activated in this connection largely depend on the structure of the clothes drying machine involved. Anyway, described below will be the functions that must be activated in this connection in three different, but basic kinds of clothes drying machines, i.e.:

1)—condenser-type clothes drying machine with independent control (two motors) of the fan 4 for the flow of drying air and the fan 8 for the flow of condenser-cooling air;

2)—clothes drying machine in which said two fans 4, 8 are solely operable in a synchronous and biunivocal manner; in this machine, the axles of said two fans 4 and 8 are connected in a known manner—even via appropriate linkage mechanisms and gears—to a single drive motor 9 so that the rotation of this motor causes said two fans to correspondingly rotate synchronously; this drive motor is controlled by appropriate control means (not shown) that are adapted to let it rotate in both possible directions of rotation thereof; this in turn allows said two fans to be driven into rotating in a selective, but in all cases mutually consistent manner (i.e. when a first fan rotates in a given direction, the second fan will always rotate in a single and sole direction of its own; when the first fan is then caused to change its direction of rotation, even the second one will change its own direction of rotation);

3)—exhaust-type clothes drying machine, i.e. a machine that is not provided with a condenser arrangement, but rather lets the moisture-laden hot air directly outside.

With reference to FIG. 1, in a clothes drying machine of the type indicated under a) above there is provided a drum 2 adapted to hold the clothes to be dried, to which there is associated a conduit 3 for the circulation of the drying air; this conduit extends also through a condenser 6, which is adapted to cause the moisture contained in the drying air flowing therethrough to condense, said condenser being furthermore flown through by a flow of "cold" air, i.e. air taken in from the outside ambient and sent to said condenser 6 via a corresponding conduit 7.

Both conduits 3 and 7 contain two respective fans 4, 8 therewithin, which are provided to circulate the drying-air flow and the cooling-air flow, respectively.

For a drying cycle according to the present invention to be implemented and carried out in a clothes drying machine of the above-indicated kind, a programme is provided in which, upon occurrence of the afore-noted pre-set condition of time elapsed from the beginning of the cycle or residual moisture content in the clothes, the fan associated to the cooling-air conduit is either stopped or significantly slowed down, while the remaining functions and parts of the machine keep operating in the same way as before.

Owing to said fan being in this way fully or partially prevented from operating, the resulting flow of cooling air will be practically fully abated or significantly reduced, so that the flow of drying air in the condenser will be neither cooled down nor dehumidified.

The fact that the flow of drying air fails in this way to be dehumidified is not a problem, since the clothes are not due to undergo a real drying effect in this phase, but rather a plain rise in the temperature thereof, as brought about exactly by the sensible increase in the temperature of the drying air that is no longer cooled down when flowing through the condenser.

Then, upon a certain time having elapsed or the moisture content of the clothes having decreased below a given value, this disinfection step of the cycle is interrupted.

In the case of a clothes drying machine of the kind indicated under 2) above, as illustrated by way of example in FIG. 2, there are a couple of facts to be duly considered in the first place. In these machines, the fan producing the stream of drying air operates at a same level of efficiency in both directions of rotation, so as to avoid disadvantaging the drying air circulation when the fan rotates in the inverted direction, the fan producing the stream of cooling air operates in a highly efficient manner when rotating in its main direction of rotation, while the efficiency decreases noticeably when the direction of rotation is inverted. This fact is largely known to be due to the need for the air to be prevented from being cooled down to an excessive extent during rotation in the reverse direction, since the drying air, particularly in the initial phases of the drying cycle, is still cold, so that any further cooling would only produce the effect of unnecessarily extend the duration of the drying cycle.

In a clothes drying machine of this kind, therefore, all it takes is to cause the machine to only operate in the reverse direction of rotation for the stream of drying air flowing through the condenser to be just cooled down insignificantly, thereby obtaining an ultimate effect similar to the one brought about in the afore-described clothes drying machine of the kind indicated under 1) above, where the condenser practically does not cool down the drying air, or does it to just a negligible extent, so that the drying air itself not only remains quite hot, but tends to even heat further up, thereby achieving the desired result.

Figure 3:
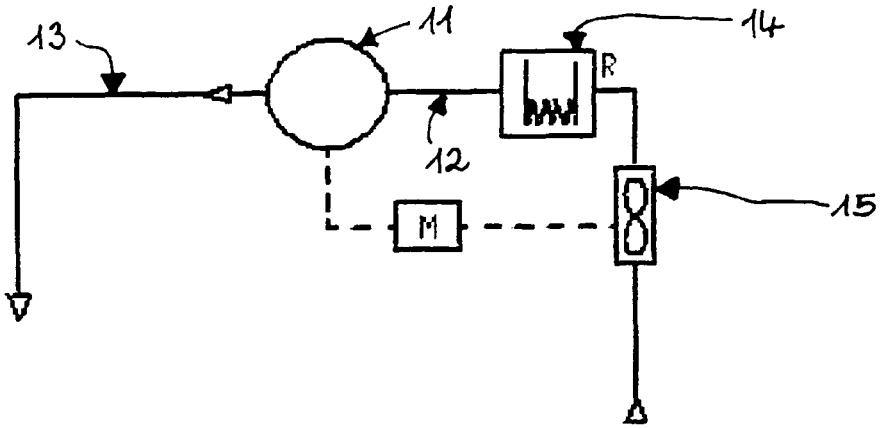
FIG. 3 is a symbolical schematic view of an exhaust-type clothes drying machine.

In the case of a clothes drying machine of the kind indicated under 3) above, which is illustrated schematically in FIG. 3, this can be noticed to comprise a drum 11, an air inlet conduit 12, an air outlet conduit 13, a heating element (arranged in the conduit 12 and not shown in the Figure), and an air circulating fan 15.

In a machine of this kind, the increase in temperature of the drying air is brought about by joining the inlet conduit 12 and the outlet conduit 13 together at the free ends thereof.

Figure 5:
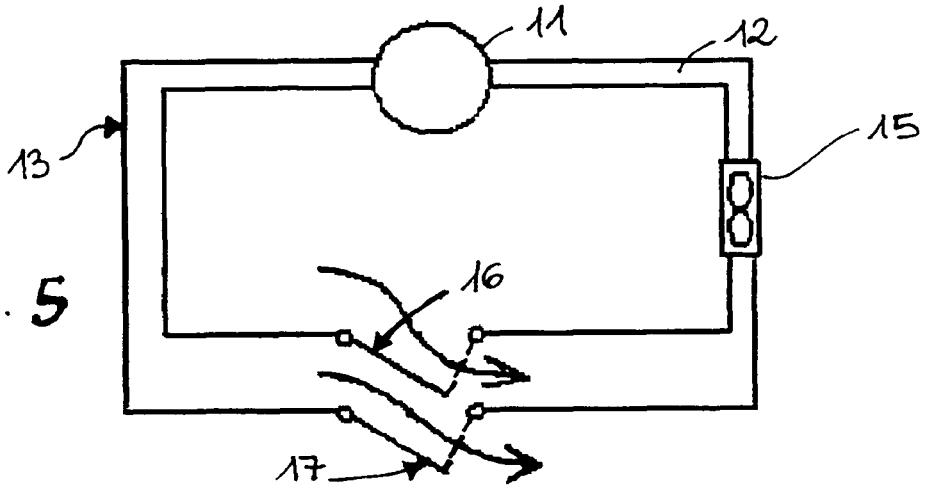
FIGS. 4 and 5 are respective symbolical schematic views of two operating states according to the present invention of the machine illustrated in FIG. 3.
Figure 4:
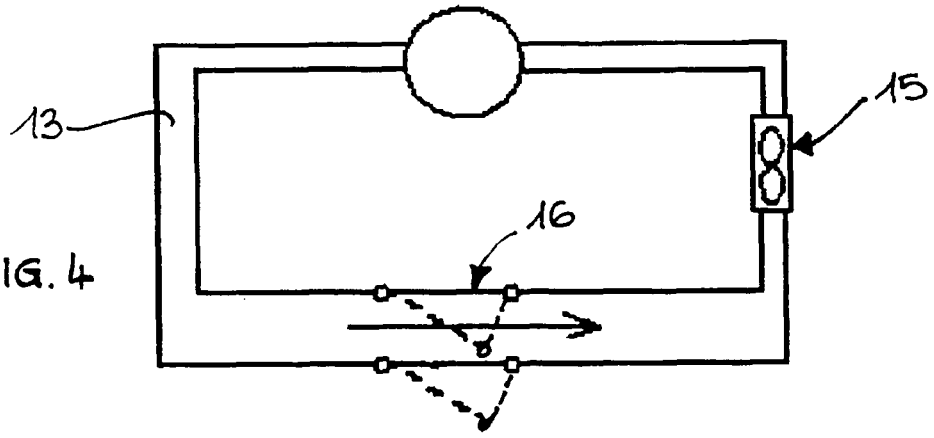

In this manner, a substantially closed-loop conduit is provided, in which there is however arranged a set of flaps 16, 17, or equivalent flow diverting means, adapted to selectively create the closed-loop circuit for the drying air, as illustrated in FIG. 4, or separate said two conduits 12 and 13, so as this is required in the normal operation of the machine and is illustrated in FIG. 5.

In a machine of this kind, the temperature rise phase inside the drum is most easily obtained by simply allowing the air to go on being heated up and circulated as usual in a circuit 12, 13 that now has a closed-loop configuration. Since the air being let again into the drying drum is in this case the same air that has just been let out therefrom, and is of course at a temperature that is certainly much higher than the ambient one, it logically ensues that the aggregate temperature of the air that is eventually blown into the drum will lie at a value that is sensibly higher than the one that the same air would attain if it were just taken in from the outside ambient in the usual manner.

Figure 6:
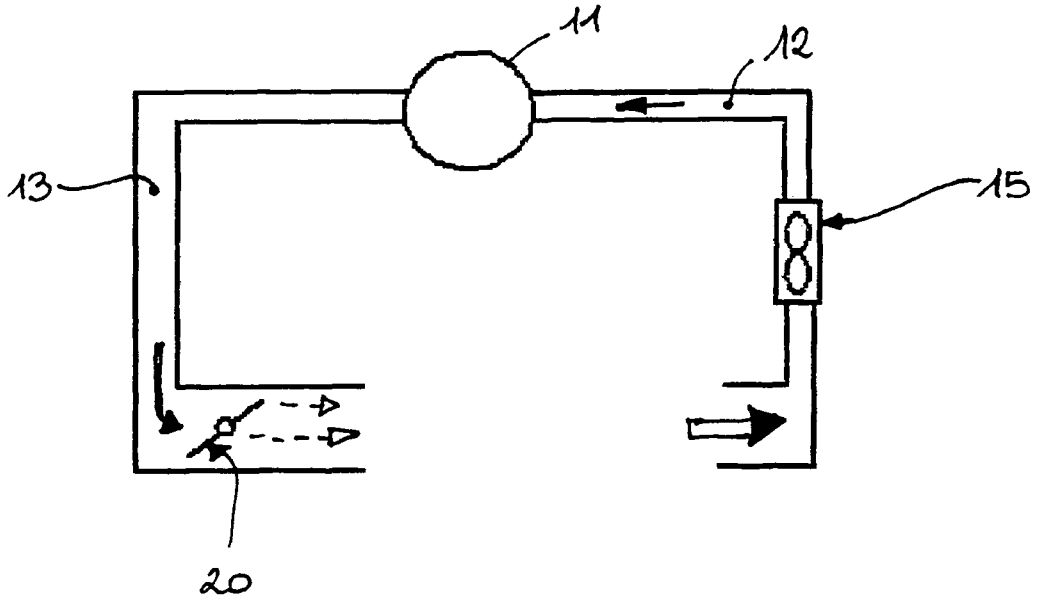
FIG. 6 is a view of a different embodiment of the machine illustrated in FIG. 3.

A variant form of the above embodiment is shown in FIG. 6, which illustrates a clothes drying machine with an air circuit that is open on both the inlet and the outlet sides thereof, wherein the outlet conduit 13, however, is provided with a flap 20 that is capable of being actuated in such a manner as to be able to selectively close or open the same conduit. When said temperature rise phase is to be started and carried out, this flap 20, which is normally kept in its open condition, is closed; as a result, the circulation of the air inside the drum comes almost to an end, or is anyhow sensibly reduced, while the drum itself keeps anyway being affected by a certain volume of air that is heated up by the heating element and pushes for entering the drum.

Even if the air circulation within the drum comes almost to a stop, the effect of the above-mentioned hot air pushing for entering the same drum is fully adequate in view of bringing about the desired temperature increase thereinside.

Exhaustive experiments done in this connection have shown that an excellent result in the disinfection of clothes loaded in a drum is achieved with a flow of air being let into the drum at a temperature of at least 130° C. when the residual moisture content of the same clothes is not lower than 40, wherein said moisture content shall preferably not be brought down to any lower value than 20% in view of avoiding the afore-mentioned "baking" effect of the clothes.

As an alternative, said temperature rise phase shall have a duration of not less than 15 minutes in view of reliably ensuring an adequate level of disinfection, without disadvantaging the overall duration of drying cycle and the energy usage record of the machine to any excessive extent.

As it can be appreciated from the above disclosure, a clothes drying machine according to the present invention differs solely in that it is adapted to carry out a particular operating programme, while not a single mechanical part thereof is modified, except for the simple modification required in an exhaust-type clothes drying machine, as illustrated in FIGS. 2 and 3.

All other modifications can be implemented simply through a suitable operating cycle, whose embodiment and application to a clothes drying machine are fully within the ability of those skilled in the art.

The invention claimed is:

1. A method of drying clothing, comprising the steps of:
providing first heated air into a drum holding clothing to be dried;
monitoring a condition of said clothing in said drum during said drying;
detecting when said condition nears or reaches a predetermined moisture content threshold; and
responsive to detecting that said condition is nearing or has reached said predetermined moisture content threshold, providing second heated air into the drum, said second heated air being heated to a greater temperature than said first heated air and being provided for a period of time for raising a temperature of the clothing.

2. The method of claim 1, wherein said predetermined threshold is between 40% and 20% moisture content.

3. The method of claim 1, wherein said condition is an elapse of time.

4. The method of claim 1, wherein said predetermined threshold is greater than or equal to 30% moisture content.

5. The method of claim 1, further comprising the step of, after an elapsed predetermined period of time, providing third heated air into the drum, said third heated air being heated to a lower temperature than said second heated air.

6. The method of claim 1, wherein said temperature of said second heated air is at least 130 degrees Celsius.

7. The method of claim 1, wherein said period of time is at least 15 minutes.

8. A method of drying clothing, comprising the steps of:
providing first heated air into a drum holding clothing to be dried;

monitoring a moisture content of said clothing in said drum during said drying;

detecting when said moisture content is reduced to a predetermined threshold;

responsive to detecting that said moisture content has been reduced to said predetermined threshold, providing second heated air into the drum, said second heated air being heated to a greater temperature than said first heated air and being provided for raising a temperature of the clothing; and after a predetermined period of time or in response to detecting when said moisture content reaches another predetermined threshold, providing third heated air into the drum, said third heated air being heated to a lower temperature than said second heated air.

9. A method of drying clothing in a clothes dryer comprising: a drum for holding clothes to be dried, a heating element, an inlet conduit through which a flow of heated air is blown into said drum using a circulation fan, an outlet conduit through which moisture-laden hot air is taken out of said drum, and a control means for executing a control program, said method comprising the steps of:

providing first heated air into the drum holding clothing to be dried;

said control means monitoring a moisture condition of said clothing in said drum during said drying;

said control means detecting when said moisture condition nears or reaches a predetermined threshold; and responsive to detecting that said moisture condition is nearing or has reached said predetermined threshold, providing second heated air into the drum, said second heated air being heated to a greater temperature than said first heated air and being provided for a period of time for raising a temperature of the clothing.

10. The method of claim 9, further comprising the steps of:

passing moisture-laden hot air removed from the drum through a condenser;

passing cooling air through a cooling-air conduit adapted for circulating the cooling air through said condenser; and using a second circulation fan provided within said cooling-air conduit, wherein said circulation fan and said second circulation fan are controllable by said control means independently of each other, wherein said increase in temperature of said second heated air is produced by a controlled reduction or cessation of the flow of cooling air circulating through said condenser.

11. The method of claim 9 further comprising the steps of:

passing moisture-laden hot air removed from the drum through a condenser;

passing cooling air through a cooling-air conduit adapted for circulating the cooling air through said condenser; and using a second circulation fan provided within said cooling-air conduit to circulate said cooling air;

rotating said circulation fan and said second circulation fan using a single motor adapted to rotate selectively in a main direction and in a secondary reverse direction, wherein the increase in temperature of said second heated air is produced by both of said circulation fan and said second circulation fan being driven to rotate in a single respective direction of rotation, so as to cause the flow of cooling air circulating through said condenser to be significantly reduced.

12. The method of claim 9, further comprising the steps of:

using a fan adapted to circulate in said drum, via said inlet conduit and said outlet conduit, a stream of air heated by an appropriate heating element;

passing moisture-laden hot air removed from the drum through a condenser;

using a second circulation fan provided within said cooling-air conduit to circulate said cooling air;

using a second circulation fan provided within said cooling-air conduit to circulate said cooling air;

rotating said circulation fan and said second circulation fan using a single motor adapted to rotate selectively in a main direction and in a secondary reverse direction and to jointly and correspondingly drive said circulation fan and said second circulation fan, sensing a temperature of an outlet conduit through which moisture-laden air is taken out of said drum using a sensor, wherein said increase in temperature of said second heated air is produced by both of said circulation fan and said second circulation fan being driven to rotate in a single respective direction of rotation, so as to cause the flow of cooling air circulating through said condenser to be significantly reduced, in response to said clothes drying machine executing a program with instructions for increasing the temperature of the air introduced in said drum to a desired value for a pre-set period of time when a moisture content of the clothes is sensed to have reached a pre-determined level.

13. A method of drying clothing, comprising the steps of:

providing heated air into a drum holding clothing to be dried in a first drying phase, wherein a temperature of said heated air is constrained to being below a first temperature;

monitoring a moisture content of said clothing in said drum during said first drying phase;

detecting when said moisture content reaches a predetermined moisture content threshold; and responsive to detecting that said moisture content is near or has reached said predetermined moisture content threshold, providing heated air into the drum for a second drying phase, said heated air being heated to a greater temperature than said first temperature and being provided for a predetermined period of time.

14. The method of claim 13, wherein during said first drying phase, a substantial amount of moisture is removed from said heated air by a condenser prior to said heated air being provided into the drum, whereas during said second drying phase, little to no moisture is removed from said heated air by said condenser prior to said heated air being provided into said drum.

15. The method of claim 14, wherein during said first drying phase, cooling air is utilized as an air source in providing said heated air into the drum, whereas during said second drying phase, the cooling air is not utilized as an air source in providing said heated air into the drum.

16. The method of claim 13, wherein during said first drying phase, cooling air is utilized as an air source in providing said heated air into the drum, whereas during said second drying phase, the cooling air is not utilized as an air source in providing said heated air into the drum.

17. The method of claim 13, wherein during said second drying phase, said heated air has a sufficiently high moisture to thereby provide little or no drying of the clothing during said second drying phase.

18. The method of claim 13, wherein during said first drying phase, said heated air is provided as an at least partially open-loop system, whereas during said second drying phase, said air is provided as a closed-loop system.

19. The method of claim 13, wherein during said second drying phase, said clothing has a substantial amount of moisture to be removed in a third drying phase provided after said predetermined period of time elapses.

20. The method of claim 13, wherein said predetermined moisture content threshold is between 40% and 20% moisture content.

21. The method of claim 13, wherein said predetermined time is at least 15 minutes.

22. The method of claim 13, wherein said predetermined moisture content threshold is 30% moisture content.

23. The method of claim 13, wherein said heated air is provided at a temperature of at least 130 degrees Celsius during said second drying phase.

24. The method of claim 13, wherein moisture is removed from said clothing at a slower rate during said second drying phase than during said first drying phase.

25. A method of drying clothing, comprising the steps of:

providing heated air into a drum holding clothing to be dried in a first drying phase, wherein a temperature of said heated air is constrained to being below a first temperature;

monitoring a moisture content of said clothing in said drum during said first drying phase;

detecting when said moisture content reaches a predetermined moisture content threshold; and responsive to detecting that said moisture content is near or has reached said predetermined moisture content threshold, providing heated air into the drum for a second drying phase, said heated air being heated to a greater temperature than said first temperature and being provided for a predetermined period of time, wherein during said second drying phase, moisture is removed from the clothing at a slower rate than during said first drying phase; and after said predetermined time period of time elapses, providing heated air into the drum for a third drying phase for reducing a moisture content of the clothing to a desired final amount.

26. The method of claim 25, wherein during said first drying phase, cooling air is utilized as an air source in providing said heated air into the drum, whereas during said second drying phase, the cooling air is not utilized as an air source in providing said heated air into the drum.

27. The method of claim 25, wherein during said first drying phase, said heated air is provided as an at least partially open-loop system, whereas during said second drying phase, said air is provided as a closed-loop system.

28. The method of claim 25, wherein said predetermined moisture content threshold is between 40% and 20% moisture content.

29. The method of claim 25, wherein said predetermined time is at least 15 minutes.

30. The method of claim 25, wherein said predetermined moisture content threshold is 30% moisture content.

31. The method of claim 25, wherein said heated air is provided at a temperature sufficient to heat the clothing to 85 degrees Celsius during said second drying phase.

32. The method of claim 25, wherein said heated air is provided at a temperature of at least 130 degrees Celsius during said second drying phase.

33. A method of drying clothing, comprising the steps of:

providing heated air into a drum holding clothing to be dried in a first drying phase, wherein a temperature of said heated air is constrained to being below a first temperature substantially less than 130 degrees Celsius;

monitoring a moisture content of said clothing in said drum during said first drying phase;

detecting when said moisture content reaches a predetermined moisture content threshold, wherein said predetermined moisture content threshold is greater than 20% moisture content; and responsive to detecting that said moisture content has reached said predetermined moisture content threshold, providing heated air into the drum for a second drying phase, said heated air being heated to a temperature of at least 130 degrees Celsius for a predetermined period of time, wherein during said second drying phase, moisture is removed from the clothing at a slower rate than during said first drying phase; and after said predetermined time period of time elapses, providing heated air into the drum for a third drying phase for reducing a moisture content of the clothing to a desired final amount, wherein during said third drying phase, moisture is removed from the clothing at a faster rate than during said second drying phase.

34. The method of claim 33, wherein said heated air is provided at a temperature sufficient to heat the clothing to 85 degrees Celsius during said second drying phase.

* * * * *